US007560655B2

(12) United States Patent
Karaki et al.

(10) Patent No.: US 7,560,655 B2
(45) Date of Patent: Jul. 14, 2009

(54) MOVABLE CONTACT AND PUSH SWITCH USING THE SAME

(75) Inventors: Minoru Karaki, Okayama (JP); Akira Kamie, Okayama (JP); Nobumasa Nakao, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/171,549

(22) Filed: Jul. 11, 2008

(65) Prior Publication Data

US 2009/0038925 A1 Feb. 12, 2009

(30) Foreign Application Priority Data

Aug. 7, 2007 (JP) ..... 2007-205272

(51) Int. Cl.
*H01H 5/30* (2006.01)

(52) U.S. Cl. ..... 200/406; 200/516

(58) Field of Classification Search ..... 200/406, 200/516, 16 R–16 D
See application file for complete search history.

(56) References Cited

U.S. PATENT DOCUMENTS 6,563,068 B2 * 5/2003 Yamagata et al. ..... 200/406
6,756,554 B1 * 6/2004 Hu ..... 200/406
6,855,900 B1 * 2/2005 Urushibata ..... 200/406
6,995,324 B2 * 2/2006 Asada ..... 200/1 B
7,075,020 B2 * 7/2006 Asada ..... 200/1 B
7,157,650 B2 * 1/2007 Rochon ..... 200/1 B
7,230,197 B2 * 6/2007 Sano et al. ..... 200/406
7,301,113 B2 * 11/2007 Nishimura et al. ..... 200/406

FOREIGN PATENT DOCUMENTS

JP 2005-071783 3/2005

* cited by examiner

*Primary Examiner*—Michael A Friedhofer
(74) *Attorney, Agent, or Firm*—Pearne & Gordon LLP

(57) ABSTRACT

A movable contact includes a dome portion having substantially a dome shape and a periphery, and four projections provided on a concave surface of the dome portion. The periphery of the dome portion has substantially an oval shape having a longitudinal direction. The periphery having two linear peripheries in parallel with the longitudinal direction and two arcuate peripheries connected to the two linear peripheries at four corners. The four corners are arcuate. Two diagonal lines connecting the four corners intersect at a center of the dome portion. The four projections are located on the two diagonal lines at identical distances from the center. The movable contact contacts a fixed contact stably with an excellent click feeling on a pushing operation.

5 Claims, 3 Drawing Sheets

MOVABLE CONTACT AND PUSH SWITCH USING THE SAME

FIELD OF THE INVENTION

The present invention relates to a movable contact used for a push switch installed in operation panels of various electronic devices.

BACKGROUND OF THE INVENTION

Electronic devices, such as mobile telecommunication devices and Audio-Visual devices, have had various functions while having sizes, weights, and thicknesses reduced. A push switch used for operation panels in such devices is required to be thin and operate with a light click feeling, and may often include a sheet provided with a movable contact. The movable contact of the sheet is required to have a small size, to provide a light operation feeling, and to contact stably.

FIG. 4 is a plan view of conventional movable contact 1 disclosed in Japanese Patent Laid-Open Publication No. 2005-71783. FIG. 5 is a cross-sectional view of movable contact 1 at line 5-5 shown in FIG. 4. Movable contact 1 has a dome shape having its center swelling upward and has an oval shape seen from top provided by cutting both sides of a circular shape by parallel lines. Movable contact 1 is provided by punching and folding metal sheet, such as stainless steel sheet, having a spring property. A lot of movable contacts 1 may be arranged perpendicularly to the longitudinal direction of the oval shape.

An operation of movable contact 1 will be described below. Movable contact 1 is arranged to use with a fixed contact facing movable contact 1. A pushing force is applied to the swelling center of the dome shape. When the pushing force exceeds a predetermined level, the center of the dome shape turns swelling downward resiliently with a click feeling. This causes movable contact 1 to contact the fixed contact to be connected to the fixed contact electrically. Then, the pushing force applied to movable contact 1 is released or reduced. The pushing force is accordingly smaller than a predetermined level, movable contact 1 returns to its original dome shape resiliently by a self-restoring force with a click feeling. This allows movable contact 1 to remove from the fixed contact, hence being disconnected from the fixed contact electrically.

Movable contact 1 has the oval shape having both sides cut by straight lines. Movable contact 1, and consequently has a spring property smaller than that of a movable contact having a circular dome shape, accordingly providing a dull click feeling on a pushing operation. Further, movable contact 1 is required to contact a fixed contact stably.

SUMMARY OF THE INVENTION

A movable contact includes a dome portion having substantially a dome shape and a periphery, and four projections provided on a concave surface of the dome portion. The periphery of the dome portion has substantially an oval shape having a longitudinal direction. The periphery having two linear peripheries in parallel with the longitudinal direction and two arcuate peripheries connected to the two linear peripheries at four corners. The four corners are arcuate. Two diagonal lines connecting the four corners intersect at a center of the dome portion. The four projections are located on the two diagonal lines at identical distances from the center.

The movable contact contacts a fixed contact stably with an excellent click feeling on a pushing operation.

DETAILED DESCRIPTION OF THE PREFERRED EMBODIMENT

Figure 1:
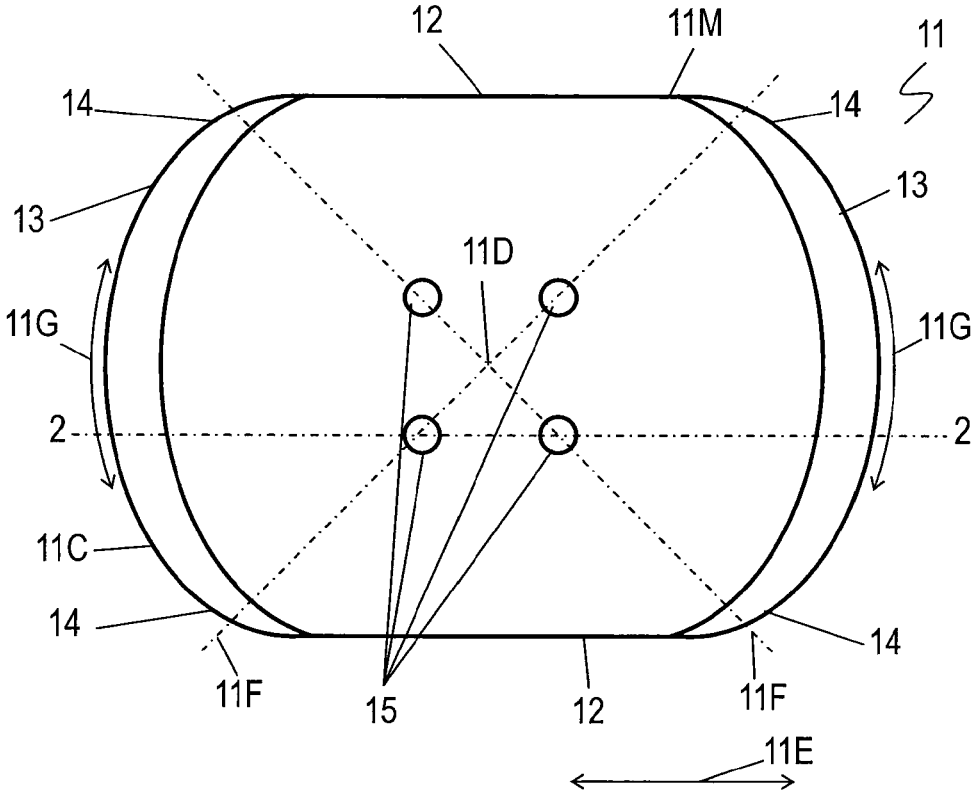
FIG. 1 is a plan view of a movable contact according to an exemplary embodiment of the present invention.
Figure 2:
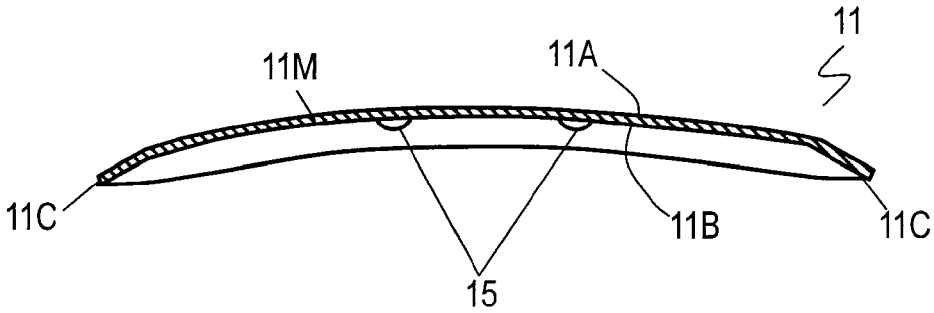
FIG. 2 is a cross-sectional view of the movable contact at line 2-2 shown in FIG. 1.

FIG. 1 is a plan view of movable contact 11 according to an exemplary embodiment of the present invention. FIG. 2 is a cross-sectional view of movable contact 11 at line 2-2 shown in FIG. 1. Movable contact 11 is made of a resilient metal sheet, such as stainless steel sheet, and includes a dome portion 11M having substantially a dome shape having convex surface 11A, concave surface 11B opposite to convex surface 11A, and periphery 11C. Four projections 15 having spherical shapes are provided on concave surface 11B.

Periphery 11C of dome portion 11M has substantially an oval shape having two linear peripheries 12 extending in parallel with longitudinal direction 11E and two arcuate peripheries 13. Linear peripheries 12 are connected with arcuate peripheries 13 at four corners 14. Corners 14 are arcuate. Two diagonal lines 11F connecting four corners 14 intersect at center 11D of dome portion 11M, movable contact 11. Four projections 15 are located on two diagonal lines 11F at same distances from center 11D, and located away from two linear peripheries 12. Each of four projections 15 is located between center 11D and each of four corners 14.

An operation of movable contact 11 will be described below. A pushing force is applied onto convex surface 11A. When the pushing force exceeds a predetermined level, convex surface 11A and concave surface 11B change into a concave surface and a convex surface, respectively, with a click feeling, thus reversing the dome shape resiliently. Then, upon the pushing force being reduced, convex surface 11A and concave surface 11B change to return to the original convex surface and concave surface, respectively, with a click feeling by a self-restoring force of the movable contact. Then, dome portion 11M of movable contact 11 returns resiliently to have its original shape shown in FIG. 2.

Movable contact 11 is used in various types of push switches. For example, movable contact 11 is accommodated in a switch case having an insulating property, and is pushed with an operation body to perform a switch operation. Convex surface 11A of movable contact 11 is held onto a lower surface of a sheet, and movable contact 11 is assembled with a circuit board having a fixed contact provided thereon.

Figure 3:
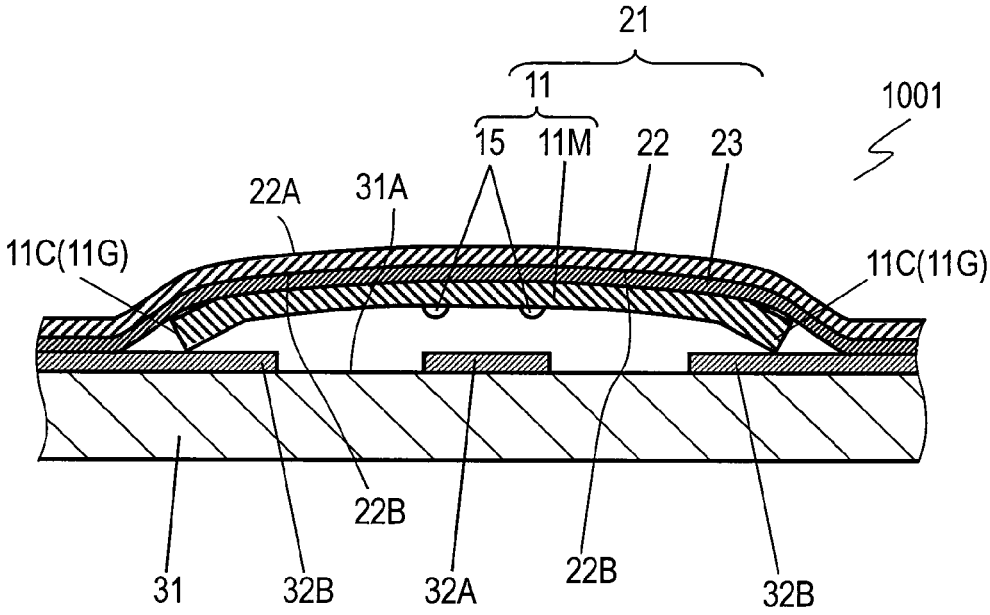
FIG. 3 is a cross-sectional view of a push switch including the movable contact according to the embodiment.

FIG. 3 shows a cross-sectional view of push switch 1001 including with movable contact 11 according to the embodiment. FIG. 3 is enlarged in a thickness direction for an explanation of push switch 1001. Sheet 22 is made of insulating film, such as polyester resin film or polyurethane resin. Sheet 22 has upper surface 22A and lower surface 22B opposite to upper surface 22A. Convex surface 11A of movable contact 11 is held and bonded on lower surface 22B of sheet 22 with adhesive 23. Movable contact 11 and sheet 22 constitute movable contact assembly 21. Movable contact assembly 21 is held and bonded on upper surface 31A of circuit board 31 with adhesive 23. Fixed contacts 32A and 32B made of conductive material, such as metals, are provided on upper surface 31A of circuit board 31. Periphery 11C of movable contact 11 is mounted on fixed contact 32B. Fixed contact 32A faces concave surface 11B, especially four projections 15, of dome portion 11M of movable contact 11 via a clearance.

An operation of push switch 1001 will be described below. A pushing force is applied on convex surface 11A of movable contact 11 from upper surface 22A of sheet 22. When the pushing force exceeds a predetermined level, convex surface 11A and concave surface 11B change into a concave surface and a convex surface, respectively, with a click feeling, thus reversing the dome shape resiliently. This causes four projections 15 to contact fixed contact 32A, and hence, connects fixed contact 32A to movable contact 11 electrically to connect fixed contact 32A to fixed contact 32B electrically, thus turning on push switch 1001. Then, when the pushing force is reduced or released, convex surface 11A and concave surface 11B return to have the original convex and concave shapes, respectively, with a click feeling by a self-restoring force of the movable contact, thus resiliently restoring the shape of dome portion 11M of movable contact 11 to the shape shown in FIG. 2. This operation removes four projections 15 from fixed contact 32A, and disconnects fixed contact 32A from movable contact 11 to disconnect fixed contact 32A from fixed contact 32B electrically, thereby turning off push switch 1001.

Linear peripheries 12 and arcuate corners 14 out of periphery 11C having substantially the oval shape do not contact fixed contact 32B, and only central portions 11G of arcuate peripheries 13 out of periphery 11C contacts fixed contact 32B. This structure fixes the area arranged to receive the pushing force applied on convex surface 11A of movable contact 11 to limit exclusively to central portions 11G of arcuate peripheries 13.

Figure 4:
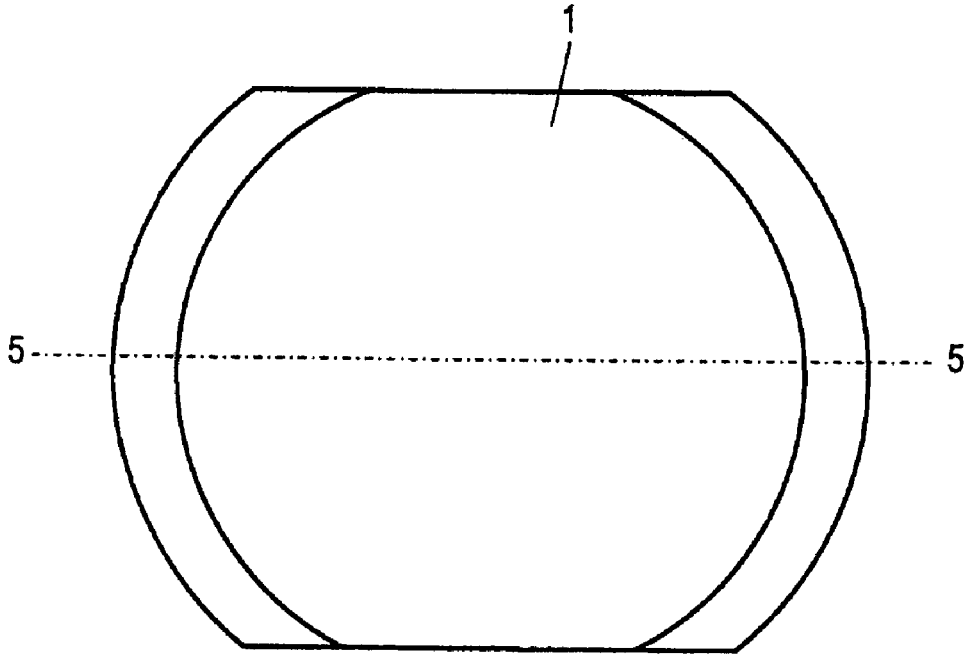
PRIOR ART FIG. 4
FIG. 4 is a plan view of a conventional movable contact.
Figure 5:
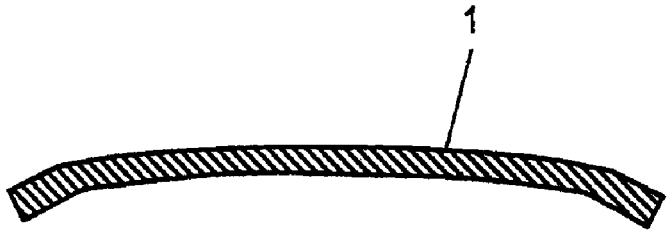
PRIOR ART FIG. 5
FIG. 5 is a cross-sectional view of the movable contact at line 5-5 shown in FIG. 4.

In the conventional movable contact 1 shown in FIGS. 4 and 5, the areas of round peripheries arranged to receive a pushing force are not fixed, providing variations of an operational feeling and a poor click feeling. In movable contact 11 according to the embodiment, central portions 11G of arcuate peripheries 13 steadily contact fixed contact 32B, thus stabilizing portions receiving the pushing force. This allows the shape of dome portion 11M of movable contact 11 to be reversed restored with the pushing force with a stable operation feeling.

Movable contact 11 contacts fixed contact 32A on four projections 15, plural positions, thereby contacting fixed contact 32A stably.

Having the semispherical shapes, projections 15 can hardly deform due to an excessively-large pushing force applied to movable contact 11, accordingly allowing movable contact 11 to contact fixed contact 32A stably. Four projections 15 are located on diagonal lines 11F by the identical distances from center 11D, and located away from linear peripheries 12. This arrangement prevents four projections 15 from influencing elastic deformation of the shape of dome portion 11M reversed and restored, accordingly providing movable contact 11 with a good operation feeling.

What is claimed is:

1. A movable contact comprising:

a dome portion made of a metal sheet having a spring property, the dome portion having substantially a dome shape having a convex surface and a concave surface opposite to the convex surface, the dome portion having a periphery; and four projections provided on the concave surface of the dome portion, wherein the periphery of the dome portion has substantially an oval shape having a longitudinal direction, the periphery having two linear peripheries in parallel with the longitudinal direction and two arcuate peripheries connected to the two linear peripheries at four corners, the four corners are arcuate, two diagonal lines connecting the four corners intersect at a center of the dome portion, the four projections are located on the two diagonal lines at identical distances from the center, and the four projections have semispherical shapes.

2. A push switch comprising:

a movable contact including a dome portion made of a metal sheet having a spring property, the dome portion having substantially a dome shape having a convex surface and a concave surface opposite to the convex surface, and four projections provided on the concave surface of the dome portion; and a fixed contact facing the concave surface of the movable contact, wherein the periphery of the dome portion has substantially an oval shape having a longitudinal direction, the periphery having two linear peripheries in parallel with the longitudinal direction and two arcuate peripheries connected to the two linear peripheries at four corners, the four corners are arcuate, two diagonal lines connecting the four corners intersect at a center of the dome portion, the four projections are located on the two diagonal lines at identical distances from the center, the fixed contact faces the four projections, and the four projections have semispherical shapes.

3. A movable contact comprising:

a dome portion made of a metal sheet having a spring property, the dome portion having substantially a dome shape having a convex surface and a concave surface opposite to the convex surface, the dome portion having a periphery; and four projections provided on the concave surface of the dome portion, wherein the periphery of the dome portion has substantially an oval shape having a longitudinal direction, the periphery having two linear peripheries in parallel with the longitudinal direction and two arcuate peripheries connected to the two linear peripheries at four corners, at least a portion of each of the arcuate peripheries forming lowest parts of the movable contact, the four corners are arcuate, two diagonal lines connecting the four corners intersect at a center of the dome portion, and the four projections are located on the two diagonal lines at identical distances from the center.

4. The movable contact of claim 3, wherein central portions of each of the arcuate peripheries are lower than any part of the periphery.

5. The movable contact of claim 3, wherein the two linear peripheries and the four corners are higher than the central portions of the arcuate peripheries.

* * * * *